US008794995B2

(12) United States Patent
Wu

(10) Patent No.: US 8,794,995 B2
(45) Date of Patent: Aug. 5, 2014

(54) LOW PROFLIE CABLE CONNECTOR ASSEMBLY

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 552 days.

(21) Appl. No.: 13/089,334

(22) Filed: Apr. 19, 2011

(65) Prior Publication Data

US 2011/0256761 A1 Oct. 20, 2011

(51) Int. Cl.
*H01R 9/05* (2006.01)
*H01R 12/24* (2006.01)

(52) U.S. Cl.
CPC ..... *H01R 23/662* (2013.01); *Y10S 439/907* (2013.01)
USPC ..... 439/497; 439/607.49; 439/907

(58) Field of Classification Search
CPC ..... H01R 23/662
USPC ..... 439/579, 660, 607.49, 907, 497
See application file for complete search history.

(56) References Cited

U.S. PATENT DOCUMENTS

| | | | | |
|---|---|---|---|---|
| 4,737,117 | A * | 4/1988 | Lockard | 439/92 |
| 5,176,538 | A * | 1/1993 | Hansell et al. | 439/607.23 |
| 6,027,376 | A * | 2/2000 | Matsuura et al. | 439/638 |
| 6,062,907 | A * | 5/2000 | Tan et al. | 439/607.41 |
| 6,162,086 | A * | 12/2000 | Kuo | 439/497 |
| 6,273,753 | B1 * | 8/2001 | Ko | 439/579 |
| 6,290,542 | B1 * | 9/2001 | Kuo | 439/607.49 |
| 6,390,852 | B1 * | 5/2002 | Wang | 439/607.48 |
| 6,524,135 | B1 * | 2/2003 | Feldman et al. | 439/607.46 |
| 6,527,592 | B2 * | 3/2003 | Mochizuki et al. | 439/660 |
| 6,652,296 | B2 * | 11/2003 | Kuroda et al. | 439/95 |
| 6,676,444 | B2 * | 1/2004 | Noro | 439/579 |
| 6,705,893 | B1 * | 3/2004 | Ko | 439/607.56 |
| 6,875,048 | B2 * | 4/2005 | Lee | 439/497 |
| 6,926,562 | B1 * | 8/2005 | Wu | 439/660 |
| 6,951,487 | B2 * | 10/2005 | Ozai | 439/637 |
| 7,147,512 | B2 * | 12/2006 | Wu | 439/607.05 |
| 7,207,831 | B2 * | 4/2007 | Chen | 439/497 |
| 7,354,299 | B2 * | 4/2008 | Yamada et al. | 439/497 |
| 7,422,488 | B1 * | 9/2008 | Wu | 439/676 |
| 7,470,150 | B2 * | 12/2008 | Kuo et al. | 439/607.41 |
| 7,534,143 | B1 * | 5/2009 | Tsao et al. | 439/607.41 |
| 7,563,140 | B1 * | 7/2009 | Wan et al. | 439/660 |
| 7,618,293 | B2 * | 11/2009 | Wu | 439/660 |
| 7,824,198 | B2 * | 11/2010 | Tanaka | 439/108 |
| 7,963,805 | B2 * | 6/2011 | Ko | 439/656 |
| 8,079,853 | B2 * | 12/2011 | Tanaka | 439/108 |
| 8,100,725 | B2 * | 1/2012 | Su et al. | 439/660 |

(Continued)

FOREIGN PATENT DOCUMENTS

CN 201252184 Y 6/2009

*Primary Examiner* — Neil Abrams
(74) *Attorney, Agent, or Firm* — Wei Te Chung; Ming Chieh Chang

(57) ABSTRACT

A cable connector assembly, comprising comprises: a plurality of contacts (2) defining a plurality of first contacts (27) which may be used as power contacts and a plurality of second contacts (28), an insulative housing (1) molding outside the contacts (2), a flat-shaped cable (3) connecting with the contacts (2), the cable (3) comprises a plurality of coaxial wires arranged along the level direction, each coaxial wire comprises a plurality of inner conductors (30), two inner conductors (30) are connected with a first contact (27), and one inner conductor (30) is connected with a second contact (28), a metallic shell (4) shielding outside the insulative housing (1).

14 Claims, 6 Drawing Sheets

(56) References Cited

U.S. PATENT DOCUMENTS 8,303,329 B2 * 11/2012 Wu ..... 439/395
8,398,427 B2 * 3/2013 Wu ..... 439/497
2011/0256764 A1 * 10/2011 Wu ..... 439/607.01
2013/0178106 A1 * 7/2013 Hsueh ..... 439/626

* cited by examiner

LOW PROFLIE CABLE CONNECTOR ASSEMBLY

1. FIELD OF THE INVENTION

The present invention generally relates to a cable connector assembly, and more particularly to a low profile cable connector assembly.

2. DESCRIPTION OF RELATED ART

Universal Serial Bus (USB) is a serial bus standard to the PC architecture with a focus on computer telephony interface, consumer and productivity applications. The interface design of USB is standardized by the USB Implementers Forum (USB-IF), an industry standard organization founded by computer and communication companies. And, USB cables used to connect peripherals, such as mouse devices, keyboards, PDAs, gamepads and joysticks, scanners, digital cameras, printers, external storage, networking components, etc. For many devices such as scanners and digital cameras, USB has become a standard connection method.

China Patent Publication No. 201252184 discloses a USB plug. The USB connector comprises an insulative body, a plurality of contacts received in the insulative body, a plurality of cables connecting with the contacts and a metal shell enclosing the insulative body. Traditional USB plug has a round cable and a metal shell enclosing the insulative body, so the USB plug has a high profile. Thus, the traditional USB plug can not meet the miniaturization developing trend.

Correspondingly, it is desired to have a cable connector assembly with improved structure to address the problems stated above.

BRIEF SUMMARY OF THE INVENTION

Accordingly, an object of the present invention is to provide a low profile cable connector assembly.

In order to achieve the above-mentioned object, A cable connector assembly, comprising: a plurality of contacts defining a plurality of first contacts and a plurality of second contacts, an insulative housing molding outside the contacts, a flat-shaped cable connecting with the contacts, the cable comprises a plurality of coaxial wires arranged along the level direction, each coaxial wire comprises a plurality of inner conductors, two inner conductors are connected with a first contact, and one inner conductor is connected with a second contact, a metallic shell shielding outside the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
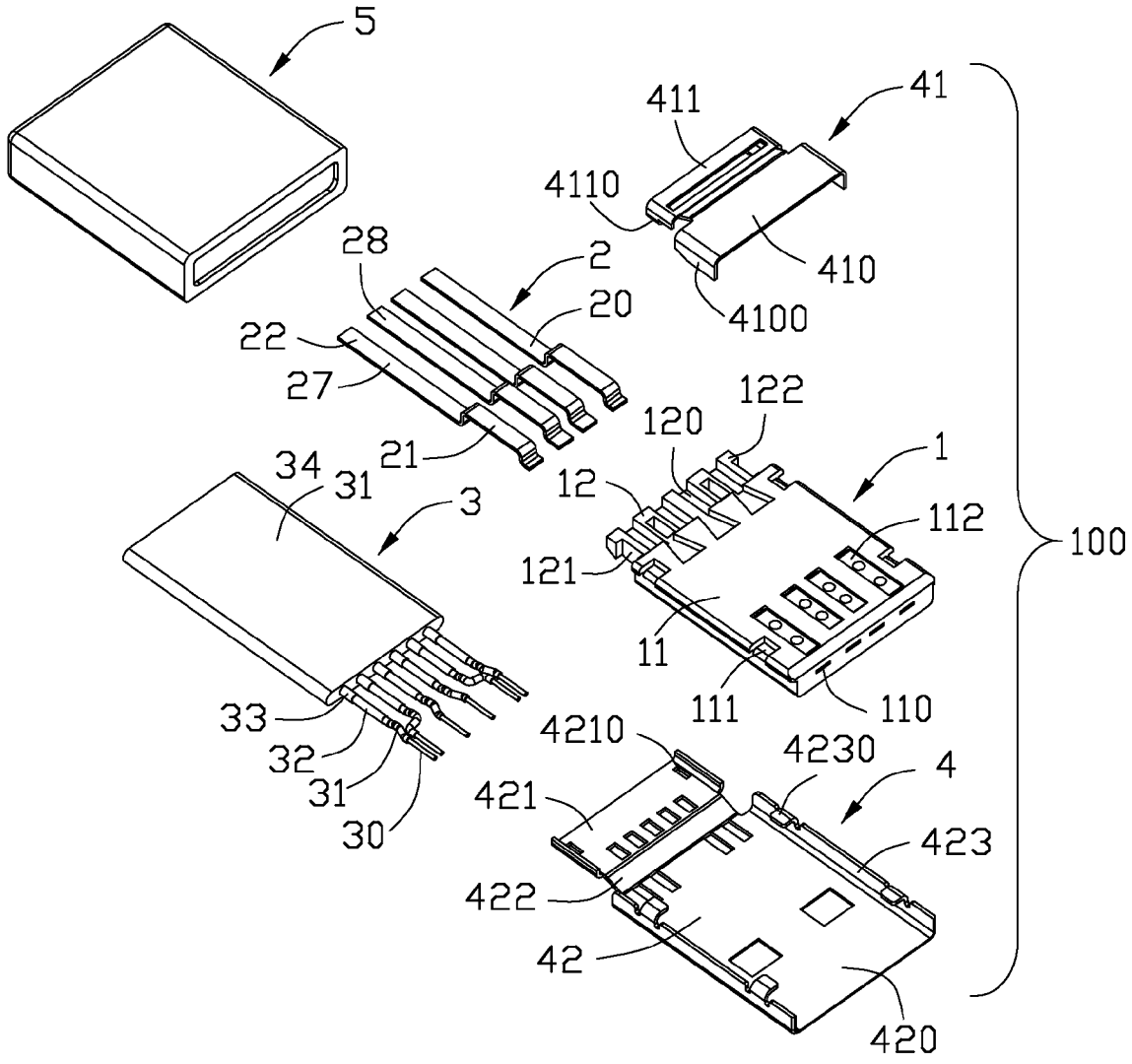
FIG. 1 is an exploded, perspective view of a cable connector assembly in accordance with the present invention.

Reference will now be made to the drawing figures to describe the present invention in detail.

Figure 2:
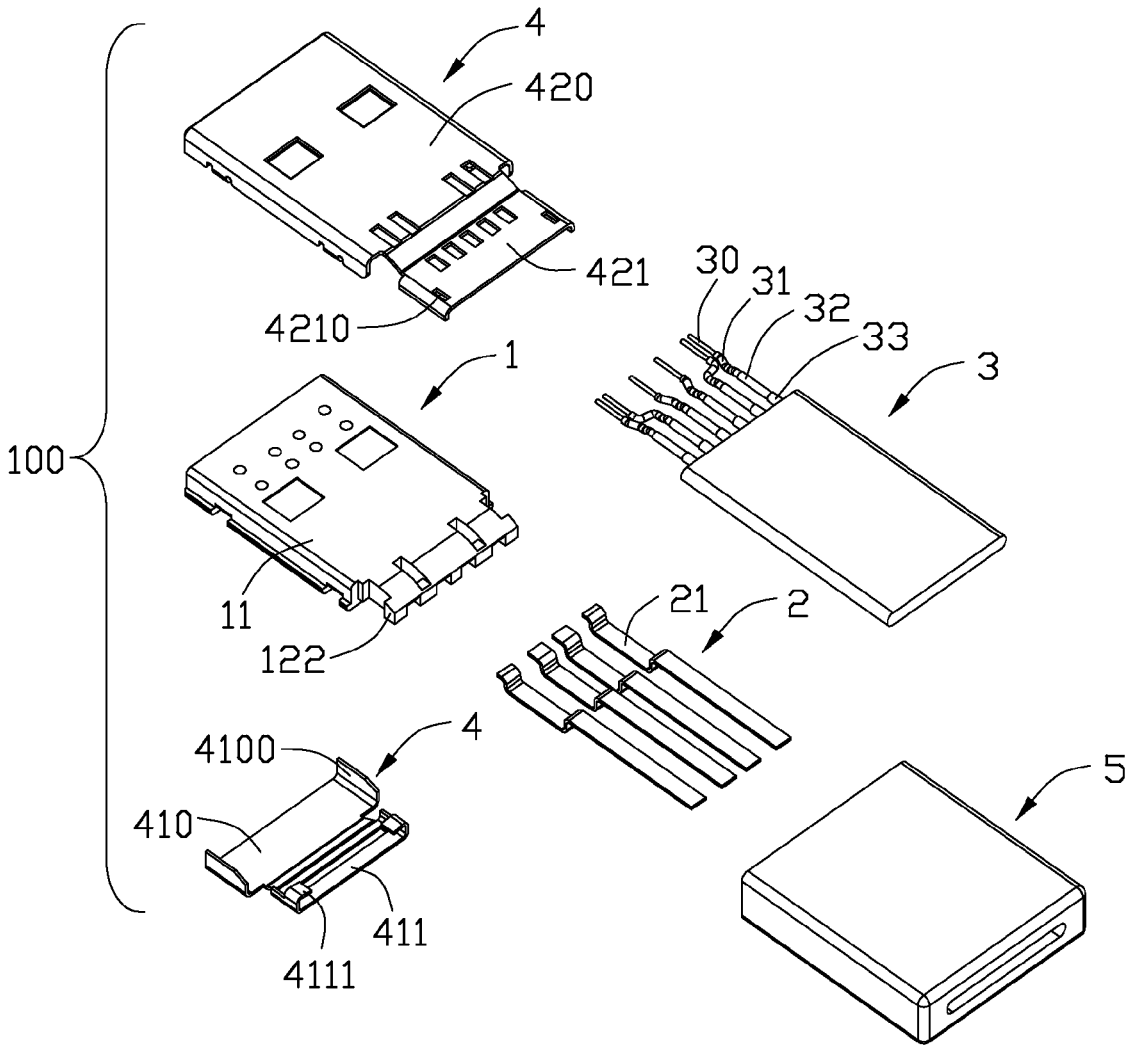
FIG. 2 is similar to FIG. 1, but viewed from another aspect.
Figure 3:
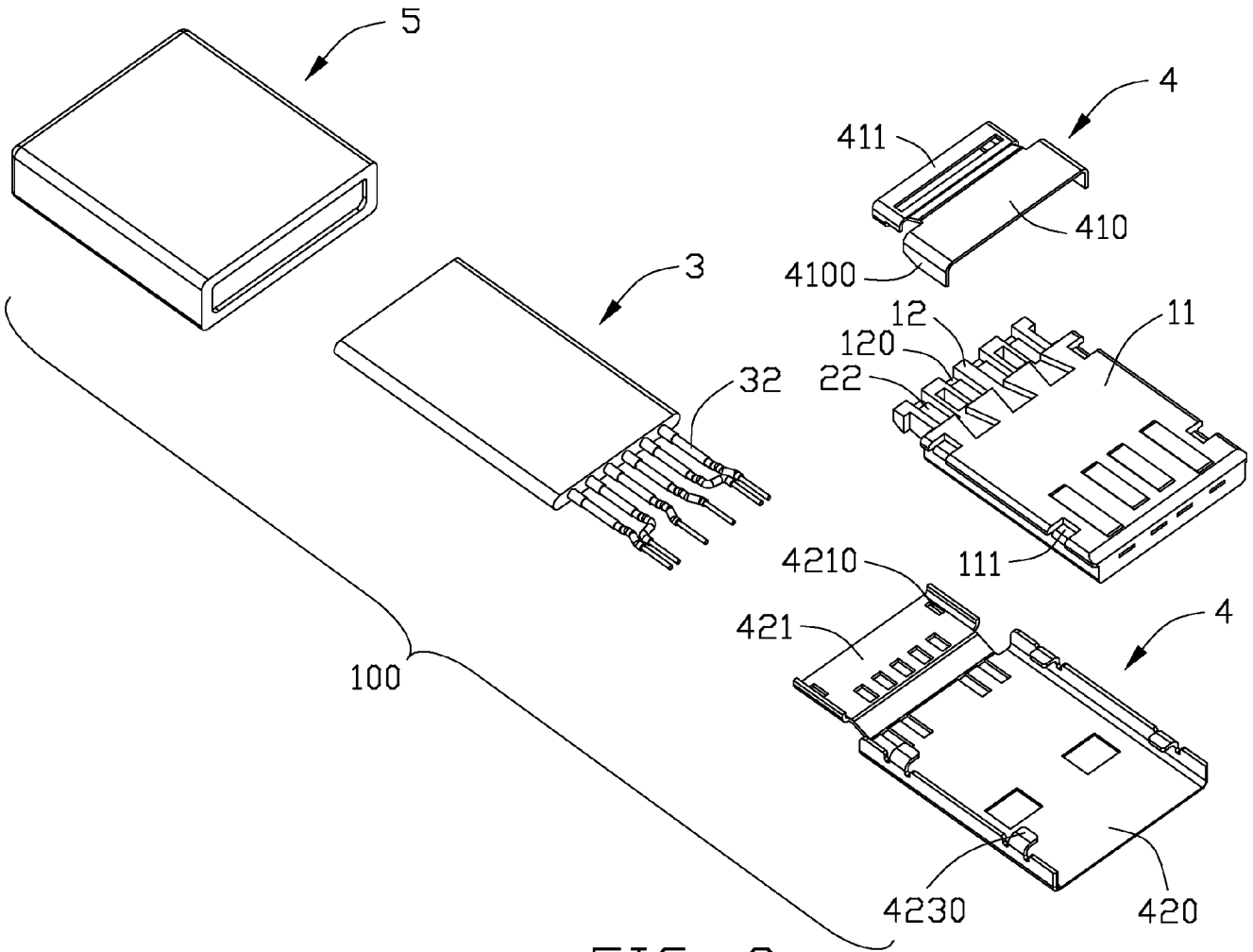
FIG. 3 is a perspective, partial assembled view of the cable connector assembly of FIG. 1.

Referring to FIGS. 1 to 2, a cable connector assembly 100 in accordance with the present invention comprises an insulative housing 1, a plurality of contacts 2 received in the insulative housing 1, a cable 3 connecting with the contacts 2 and a metal shell 4 shielding the insulative housing 1.

Referring to FIGS. 1 to 2, the insulative housing 1 comprise a base portion 11 and a tongue portion 12 extending rearwardly from the base portion 11. A plurality of terminals receiving passages 110 are defined in the base portion 11 and extended along a mating direction of the cable connector assembly 100. A plurality of terminal receiving grooves 120 are formed in an upper surface of the tongue portion 12. And the terminal receiving grooves 120 are respectively in alignment with the terminal receiving passages 110 along a front-to-back direction. A pair of locking holes 111 are recessed from an upper surface of the base portion 11 and disposed at two sides of the upper surface.

Referring to FIGS. 1 to 2, the number of the contact 2 is four, two outside contacts are defined as a pair of first contacts 27, two inside contacts are defined a pair of second contacts 28. The first contacts 27 are power contacts and the second contacts 28 are signal contacts. Each contact 2 comprises a retention portion 20, a tail portion 22 extending backwardly from the retention portion 20 and a mating portion 21 extending forwardly from the retention portion 20. The mating portion 21 is exposed on the upper surface of the insulative housing 1 and the tail portion 22 extends beyond the rear surface of the insulative housing 1. The arrangement of the mating portions 21 of the contacts 2 are in accord with the USB standard. The mating portions 21 are received in the terminal receiving passages 110 and the upper surface of the mating portions 21 are exposed in the grooves 112. The retention portions 20 are received in the terminal receiving passages 110 and the tail portions 22 are received in the terminal receiving grooves 120.

Figure 4:
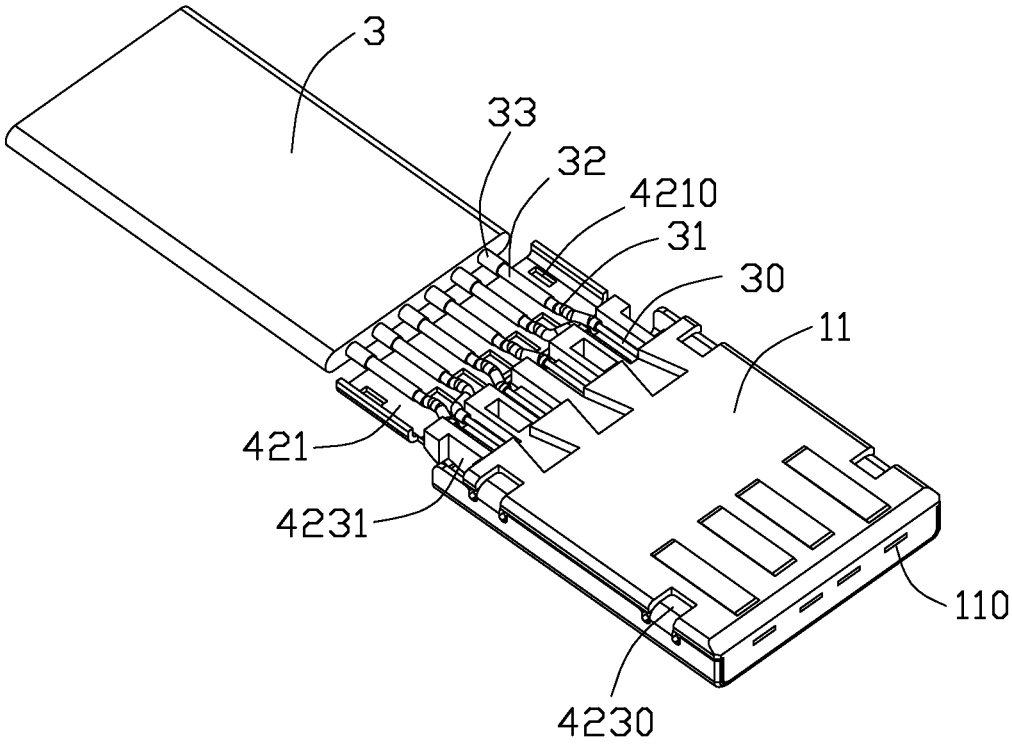
FIG. 4 is a perspective, partial assembled view of the electrical connector assembly when a top cover and a cover are removed.
Figure 5:
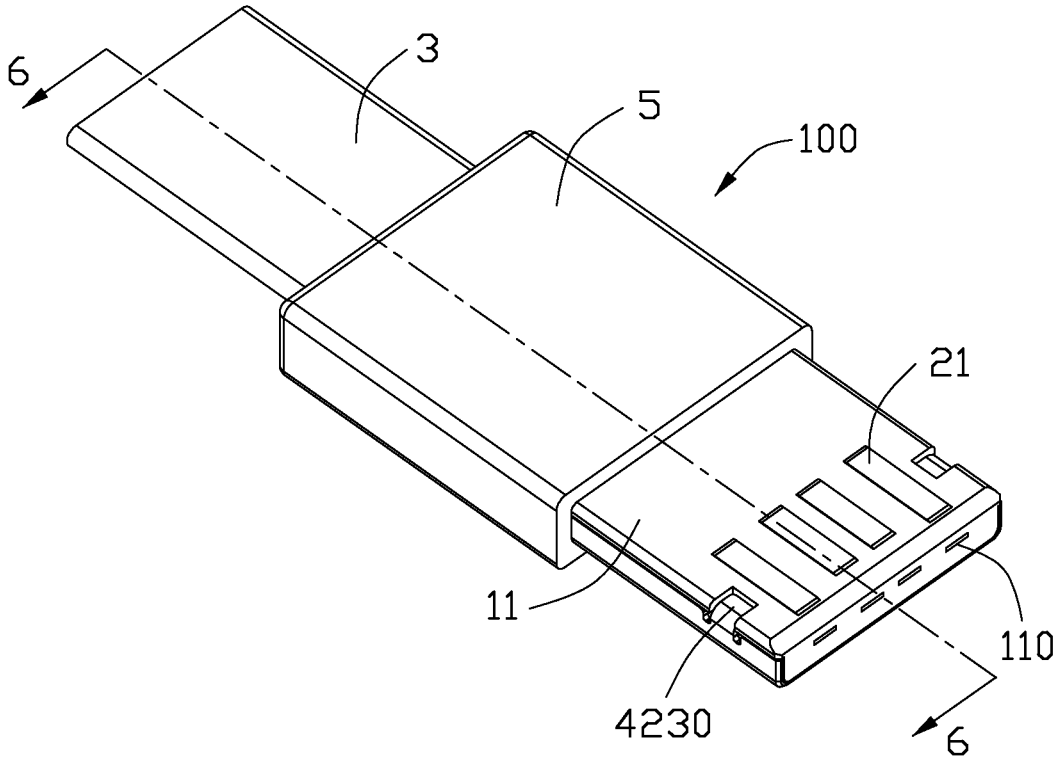
FIG. 5 is an assembled, perspective view of the cable connector assembly of FIG. 1.
Figure 6:
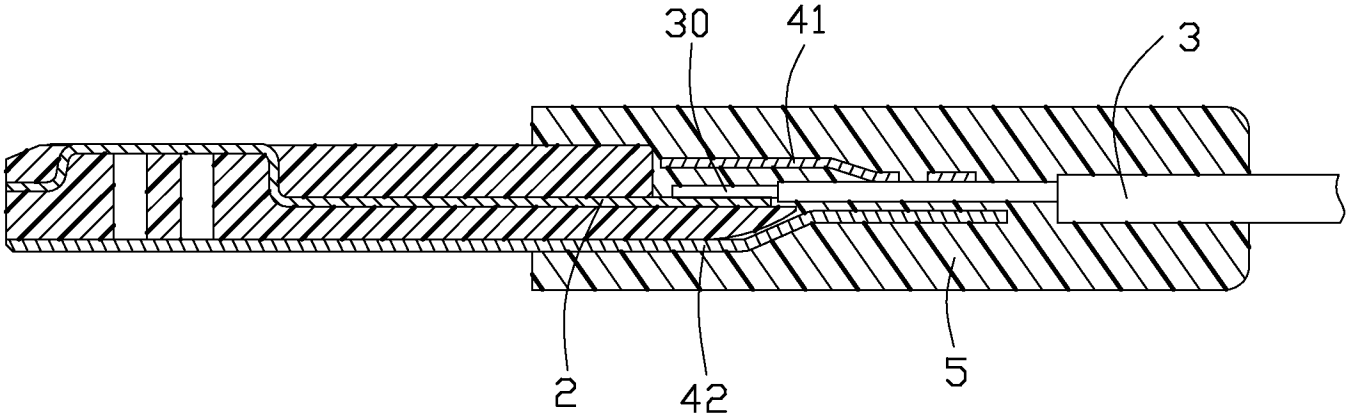
FIG. 6 is a cross-sectional view of the cable connector assembly taken along line 6-6 of FIG. 1.

Referring to FIGS. 1 to 2, the cable 3 comprises a plurality of coaxial wires arranged along the level direction. Each coaxial wire comprises an inner conductor 30, an inner insulative layer 31 enclosing the inner conductor 30, a braiding layer 32 enclosing the inner insulative layer 31 and an outer insulative layer 33 enclosing the braiding layer 32. In addition, each coaxial wire also comprises an insulative jacket 34 enclosing the outer insulative layer 33. The inner conductor 30 is exposed from the front edge of the inner insulative layer 31, the inner insulative layer 31 is exposed from the front edge of the braiding layer 32 and the braiding layer 32 is exposed from the front edge of outer insulative layer 33, and all of the outer insulative layers 33 are exposed from the front edge of the insulative jacket 34 together. Please refer to the FIG. 4, the connecting method between the contacts 2 and the cable 3 of the cable connector assembly 100 is as described: two of the inner conductors 30 are connected with a power contact 27 and one of the inner conductor 30 is connected with a signal contact 28.

The metallic shell 4 comprises a top shell 41 and a bottom shell 42 assembled to each other along a vertical direction. The top shell 41 comprises a shielding portion 410 and a extending portion 411 extending rearwardly from the shielding portion 410. A pair of tabs 4111 are formed on the lateral walls 4110 of the extending portion 411 and extended inwardly from two lateral walls 4110. The bottom shell 42 comprises a shielding portion 420 enclosing the bottom surface of the insulative housing 1, a supporting portion 421 disposed behind the shielding portion 420 for supporting the braiding layer 32 and a connection portion 422 connecting the shielding portion 420 and the support portioning 421 for supporting the tongue portion 12. A pair of locking tabs 4230 are formed on two lateral walls 423 of the bottom shell 42 for receiving into the locking holes 111. And a pair of holes 4210 are formed in the support portion 421 for enclosing with the tabs 4111. The holes 4210 extending through out the upper and lower surface of the support portion 421.

Referring to FIGS. 1 to 2 and in conjunction with FIGS. 3 to 6, in assembled with the cable connector assembly 100, the contacts 2 are received in the insulative housing 1 via the insert-molding process, the contacts 2 are received in the terminal receiving passages 110 and the tail portion 22 of the contacts 2 are received in the terminal receiving grooves 120; then the bottom shell 42 is assembled in the bottom surface of the insulative housing 1, the locking tabs 4230 are received into the locking holes 111 and the locking tabs 4230 are not beyond the upper surface of the insulative housing 1, and at the same time, the tongue portion 12 is supported on the connection portion 422, the inner conductors 30 are disposed in the terminal receiving grooves 120 and the braiding layers 32 are disposed on the supporting portion 421; and then the inner conductors 30 are soldered onto the contacts 2, two inner conductors 30 are connected with a power contact 27 and one inner conductor 30 is connected with a signal contact 28 and the braiding layers 32 are soldered onto the supporting portion 421, a pair of gaps 4231 are formed between the post 122 and the lateral wall 423 behind the locking tabs 4230; then the top shell is assembled to the bottom shell 42 along a vertical direction perpendicular to the mating portion, the tabs 4111 are locked into the holes 4210 and the lateral walls 4100 are disposed in the gaps 4231, the top shell 41 is only shielding outside the tongue portion 12 and the conjunction portion between the cables 3 and the contacts 2; and the cover 5 is molded outside of the back of the insulative housing 1, the conjunction portion of the cables 3 and the contacts 2, and partly of the cables 3. Thus, the cable connector assembly 100 is assembled.

The cable connector assembly 100 comprises a flat-shaped cable 3 for connecting with the contacts 2. Because of the exist of the flat-shaped cable 3, the cable connector assembly 100 becomes low profile and meet with the requirement of the development of the cable connector assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a plurality of contacts defining first contacts and second contacts;

an insulative housing receiving the contacts;

a flat-shaped cable connecting with the contacts, the cable comprises a plurality of coaxial wires side by side arranged along a horizontal direction, each coaxial wire having an inner conductor, and the middle one pair of conductors connected with the second contacts in a one-to-one manner, the other two pairs of inner conductors which are respectively located on two lateral sides, connected with the first contacts in a two-to-one manner;

a metallic shell shielding outside the insulative housing.

2. The cable connector assembly as claimed in claim 1, wherein the insulative housing comprises a base portion and a tongue portion extending backwardly from the base portion, a plurality of terminal receiving grooves are formed in the upper surface of the tongue portion.

3. The cable connector assembly as claimed in claim 1, wherein each coaxial wire comprises a braiding layer closing the inner conductor and the inner conductor is exposed from the front edge of the braiding layer.

4. The cable connector assembly as claimed in claim 3, the metallic shell comprises a shielding portion shielding the insulative housing and a supporting portion behind the shielding portion for supporting the braiding layer and electrically connecting with the braiding layer.

5. The cable connector assembly as claimed in claim 2, wherein a pair of locking holes are recessed downwardly from the upper surface of the base portion.

6. The cable connector assembly as claimed in claim 5, wherein the metallic shell comprises a top shell and a bottom shell assembled to each other, and a pair of locking tabs mating with the locking holes are formed in the lateral walls of the bottom shell.

7. The cable connector assembly as claimed in claim 6, wherein a pair of tabs are formed in the two lateral walls of the top shell and the tabs are extending inwardly from the lateral walls.

8. The cable connector assembly as claimed in claim 7, wherein a pair of holes are formed in the bottom shell for mating with the tabs and the holes is running through the upper and lower surface of the bottom shell.

9. The cable connector assembly as claimed in claim 7, wherein a pair of posts are defined in the lateral sides of the tongue portion and a pair of gaps are formed between the posts and the lateral walls behind the locking tabs.

10. The cable connector assembly as claimed in claim 9, wherein the front section of the lateral walls of the top shell are disposed in the gaps.

11. An electrical connector comprising:

an insulative housing defining a mating tongue with opposite upper and bottom surfaces;

a plurality of contacts disposed in the housing, each of the contacts defining a front contacting section exposed upon the upper surface of the mating tongue and a rear tail section;

a cable including a plurality of wires located behind the housing, each of said wires defining an inner conductor connected to the corresponding contact, an inner insulative layer enclosing the inner conductor, a braiding layer enclosing the inner insulative layer, and an outer jacket enclosing the braiding layer; and a metallic shell having a front portion covering the bottom surface, and a rear portion connecting to the braiding layer; wherein said wires include six wires side by side transversely arranged with one another at equal intervals, including two leftmost wires and two right most wires commonly sandwiching two middle wires, while the contacts include four contacts, including a leftmost contact and a rightmost contact commonly sandwiching two middle contacts, with different intervals on the corresponding contacting sections thereof; wherein the two middle wires are respectively connected to the rear tail sections of the corresponding two middle contacts while the two leftmost wires are commonly connected to the rear tail section of the leftmost contact and the two rightmost wires are commonly connected to the rear tail section of the rightmost contact.

12. The electrical connector as claimed in claim 11, wherein an overmold encloses a rear portion of the housing and a front portion of the cable.

13. The electrical connector as claimed in claim 11, wherein the rear portion of the shell includes a first part and a second part located by two sides of the corresponding wires while assembled to each other.

14. The electrical connector as claimed in claim 11, wherein front end regions of the two middle wires extend offset away from each other while a front end region of an inner one of the two leftmost wires extends toward the outer one, and a front end region of an inner one of the two rightmost wires extends toward the outer one.

* * * * *